US005906106A

United States Patent [19]

Brown et al.

[11] Patent Number: 5,906,106

[45] Date of Patent: May 25, 1999

[54] REFRIGERANT AIR ANALYZER AND PURGE SYSTEM

[75] Inventors: William C. Brown, Bryan; Walter D. Murray, Pioneer, both of Ohio; Charles E. Dull, Fort Wayne, Ind.

[73] Assignee: SPX Corporation Robinair Division, Montpelier, Ohio

[21] Appl. No.: 08/957,185

[22] Filed: Oct. 24, 1997

[51] Int. Cl.[6] ..... F25B 43/04

[52] U.S. Cl. ..... 62/195; 62/126

[58] Field of Search ..... 62/158, 195, 149, 62/126, 129

[56] References Cited

U.S. PATENT DOCUMENTS

| | | | |
|---|---|---|---|
| 2,499,170 | 2/1950 | Shoemaker | 62/115 |
| 4,441,330 | 4/1984 | Lower et al. | 62/149 |
| 4,470,265 | 9/1984 | Correia | 62/77 |
| 4,805,416 | 2/1989 | Manz et al. | 62/292 |
| 4,890,459 | 1/1990 | Havemann | 62/126 |
| 5,005,369 | 4/1991 | Manz | 62/195 |
| 5,158,747 | 10/1992 | Manz et al. | 422/98 |
| 5,172,562 | 12/1992 | Manz et al. | 62/149 |
| 5,231,842 | 8/1993 | Manz et al. | 62/77 |
| 5,261,249 | 11/1993 | Manz et al. | 62/149 |
| 5,295,360 | 3/1994 | Olds et al. | 62/127 |
| 5,371,019 | 12/1994 | Manz et al. | 436/126 |

*Primary Examiner*—William Doerrler
*Attorney, Agent, or Firm*—Kinney & Lange, P.A.

[57] ABSTRACT

A refrigerant air analyzer and purge system for detecting and purging air within a refrigerant system or supply. The analyzer includes a vented test chamber, means for controlling a flow rate of refrigerant and an oxygen sensor. The means for controlling receives refrigerant from the refrigerant supply and provides the refrigerant to the test chamber through an inlet of the test chamber. The means for controlling limits the pressure and flow rate of refrigerant provided to the test chamber. The oxygen sensor is coupled to the test chamber and produces a signal which is a function of the oxygen level within the test chamber. The means for controlling is connected to the oxygen sensor for receiving the oxygen signal and providing a display.

50 Claims, 1 Drawing Sheet

REFRIGERANT AIR ANALYZER AND PURGE SYSTEM

BACKGROUND OF THE INVENTION

The invention pertains to the identification and purging of air in a refrigerant handling system. More particularly, it pertains to a refrigerant air analyzer and purge system.

Air, or oxygen, is a major contaminant when it exists within a refrigerant system at levels as low as two percent. One major problem arising from air within a refrigerant system is the creation of higher than normal pressure levels within the system. This over-pressure situation over-taxes the system resulting in premature deterioration and failure of system components. Ultimately it also may create or enlarge a leak within the system.

The presence of air within the system can also create a problem due to moisture which is contained within the air. At expansion points within the system, the moisture drops out of the air in the form of ice crystals. The ice crystals collect at the expansion points and either slow or prevent the flow of refrigerant through the system. When the expansion valve warms, it melts the ice crystals and the refrigerant is again allowed to flow through the system unimpeded. However, this process continually repeats itself which causes intermittent cooling and inefficient operation of the system.

Also, refrigerant oil readily absorbs moisture and will pull moisture from the air contained within the system. This causes corrosion or the creation of a sludge which over time plugs strainers, expansion valves and capillary tubes making the system inoperable or less efficient. A need therefore exists to identify the presence of air and purge it from the refrigerant supply.

Additionally, due to the harmful effects of chlorofluorocarbon (CFC) refrigerant upon the ozone layer when it is released into the atmosphere, it is becoming common practice to recover and reuse refrigerant when servicing a system rather than vent it to the atmosphere and replace it with new refrigerant. The harmful effects of refrigerant have also decreased its availability. Recovery and reuse of refrigerant creates the potential for contamination of either a refrigerant supply tank or a refrigerant system if purification means such as those disclosed in U.S. Pat. Nos. 5,005,369; 5,172,562; 5,231,842; and 5,261,249 are not used. However, these purification means are expensive, bulky, and may needlessly be performed, which increases the cost and the time to service the unit when it may not even be contaminated. Therefore, a need exists to determine whether a source of refrigerant is contaminated with air or oxygen which can then be purged from the refrigerant prior to use.

Another source of contamination can result from the mixture of different types of refrigerants. There are various types of refrigerants such as R12, R22, R134a and R502. Each system is designed to operate with a specific type of refrigerant. When a different refrigerant or combination of refrigerants is introduced into the system, the system will not operate properly. To prevent contamination from other refrigerants, various techniques have been disclosed in U.S. Pat. Nos. 5,158,747; 5,295,360; and 5,371,019. These techniques identify the type of refrigerant contained within the system or supply tank, but they do not identify the amount or presence of air within the system or tank or purge the air from the system. Furthermore, their test chambers are enclosed, which necessitates evacuation of the test chamber for cleaning purposes prior to re-use in order to obtain accurate measurements, and makes them more difficult and less portable to use.

A significant obstacle exists in identifying or measuring the presence of air down to low levels, such as two percent, within a refrigerant system or a supply tank. This problem is created due to the excessive pressure that can exist within the system or the supply tank. The pressure, within the system or the supply tank, can reach levels of 500 pounds per square inch (psi) or greater, but a standard oxygen sensor with sufficient sensitivity to measure the destructive low levels of oxygen is only capable of operating up to a pressure level which is significantly less than 500 psi. Therefore, it is necessary to protect the oxygen sensor from excessive pressure levels.

One solution used in evacuation of a refrigerant system is to monitor the pressure level of the refrigerant system and once the pressure level of the system is sufficiently low, to open a solenoid valve. Opening the solenoid value will release refrigerant across another sensor which is more sensitive to lower pressure levels. The more sensitive pressure sensor monitors the pressure level until it meets a minimal threshold level identifying the completion of the evacuation process. This technique is disclosed in U.S. Pat. Nos. 4,441,330; 4,470,265 and 5,172,562 ('562 patent). These known devices describe a refrigerant recovery or recharging system but do not expose their respective pressure sensors to the refrigerant supply until the pressure level is sufficiently low, around 40 psi as disclosed in the '562 patent. However, attaining a pressure level this low before measuring for oxygen would necessitate nearly emptying the system prior to taking an oxygen measurement. Such a procedure would not only defeat the purpose of analyzing the entire supply, but would create inaccurate measurements that are taken in an inefficient manner to assess the air contamination of the entire system.

A second solution to creating a robust, sensitive sensor, would be to use an advanced oxygen sensor capable of accurate measurements in environments ranging from around 20 psi to over 500 psi. However, this technique would significantly increase the production costs, making the sensor not cost effective. Thus, there exists no known device to accurately detect and purge the presence of air from within a refrigerant system or supply that is self-contained, portable, robust and economically priced.

SUMMARY OF THE INVENTION

The invention is a device and method to identify and purge air from within a refrigerant supply or system. The device comprises a vented test chamber having an inlet, means for connecting between the inlet of the test chamber and the refrigerant supply, and an oxygen sensor.

The means for connecting between the inlet of the test chamber and the refrigerant supply controls the flow of refrigerant from the refrigerant supply to the test chamber. The oxygen sensor is coupled to the test chamber for producing a signal which is a function of the oxygen level within the test chamber. As refrigerant flows into, fills up and is released from the test chamber, the oxygen sensor is able to analyze the refrigerant for oxygen. The means for connecting receives the signal produced by the oxygen sensor and provides a display as a function of the oxygen level within the test chamber. The air analyzer is thus able to identify and measure the presence of oxygen down to low levels in refrigerant contained under a wide range of pressures.

DETAILED DESCRIPTION OF THE PREFERRED EMBODIMENTS

Figure 1:
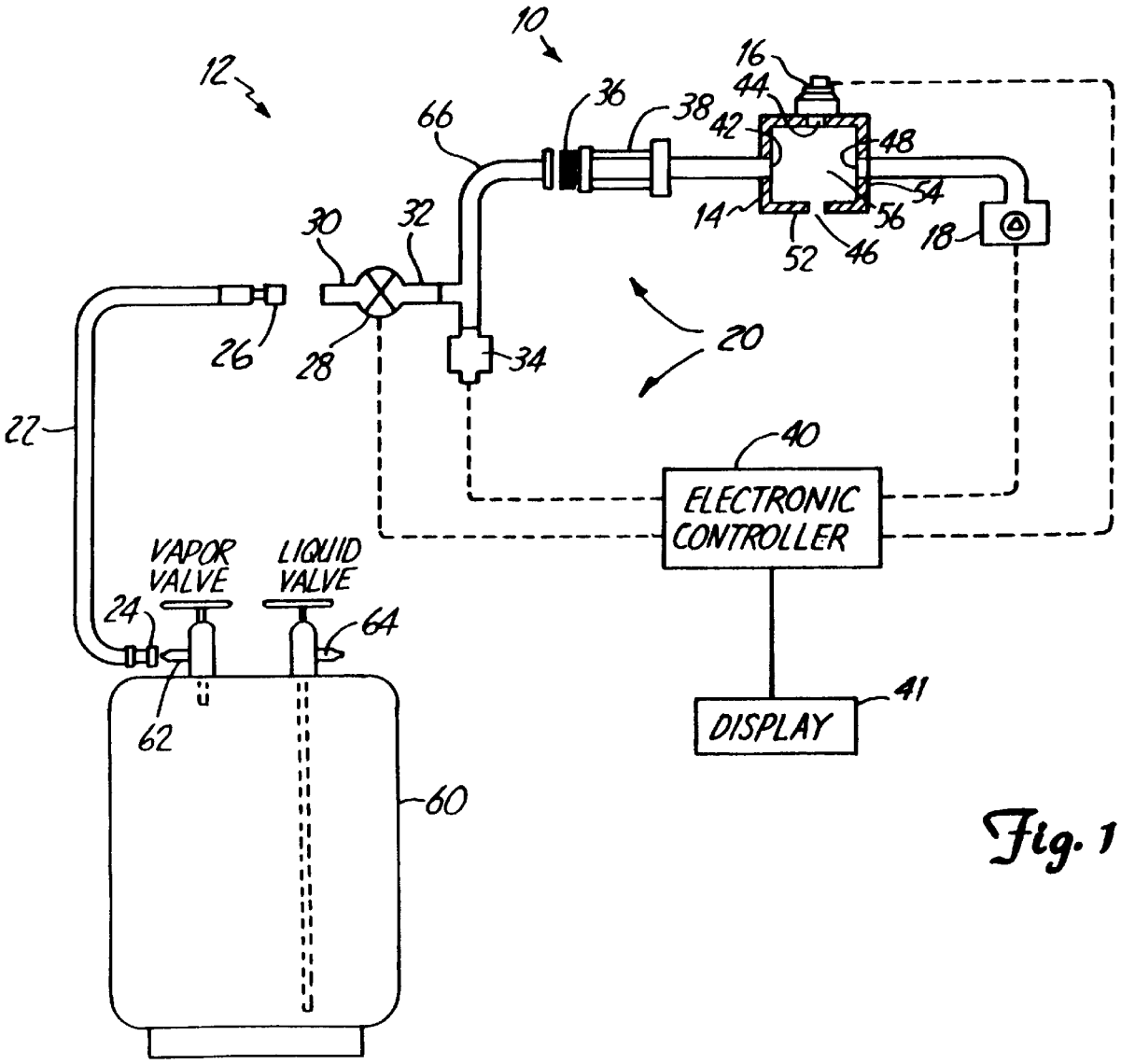
FIG. 1 is a schematic diagram of a refrigerant air analyzer of the present invention.

In FIG. 1, a preferred embodiment of a refrigerant air analyzer and purge system 10 is shown. The system 10 includes means for connecting 12, a vented test chamber 14, and an oxygen sensor 16. Additionally, in a preferred embodiment, an air pump 18 could be incorporated as well.

The means for connecting 12 includes a flow regulator 20, a test hose 22, having a distal end coupling 24 and a proximal end coupling 26, and a solenoid valve 28, having an inlet 30 and an outlet 32. The flow regulator 20 preferably includes a pressure sensor 34, a screen 36, an orifice 38, an electronic controller 40 and a display 41.

In a preferred embodiment, the test chamber 14 has an inlet 42, a first port 44, a vent 46, and additionally, a second port 48 if the air pump 18 is included. The test chamber 14 is further defined by a top 50, a bottom 52 and a side wall 54, which together create an inner chamber 56.

The distal end coupling 24 of the test hose 22 enables connection of the system 10 to a refrigerant supply 60. The distal end coupling 24 is preferably connected to a vapor valve 62 rather than a liquid valve 64 of the refrigerant supply 60, or to the highest point of the refrigerant supply 60 or refrigerant system. This will facilitate the testing and purging process because oxygen will separate from the refrigerant due to its less weight and will collect at the highest point of the system. However, if necessary, the distal end coupling 24 could be connected to the liquid valve 64, or to other parts of the refrigerant system. The proximal end coupling 26 of the test hose 22 is connected to the inlet 30 of the solenoid 28. In a preferred embodiment, the test hose 22 is of minimum length to facilitate cleaning, but allows the flow of refrigerant vapor or liquid as well as other materials that may exist within the refrigerant supply 60.

Refrigerant that flows through the test hose 22 is received by the solenoid 28. The solenoid 28 is connected to and controlled by the electronic controller 40. When commanded by the electronic controller 40, the solenoid 28 either opens or closes to either allow refrigerant to flow, or not flow, out of the outlet 32.

The pressure sensor 34 is preferably located at the outlet 32 of the solenoid 28. The pressure sensor 34 measures the pressure level at the outlet 32 and produces a pressure signal which is a function of the existing pressure level at the outlet 32. The pressure sensor 34 is connected to and communicates the pressure signal to the electronic controller 40. The electronic controller 40 analyzes the pressure signal as part of the determination of when to open the solenoid 28 and allow refrigerant to flow through the system 10. In a preferred embodiment, the electronic controller 40 maintains a pressure level of approximately 25–60 psi at the outlet 32 of the solenoid 28 as measured by the pressure sensor 34. The electronic controller 40 preferably pulses the solenoid 28 with a command signal to open the solenoid 28 for a short period of time when the pressure level at the outlet 32, as measured by the pressure sensor 34, drops below approximately 30 psi.

The orifice 38 is also connected to the outlet 32 of the solenoid 28, preferably through a manifold 66. The orifice 38 receives refrigerant from the solenoid 28 and provides the refrigerant to the test chamber 14. The screen 36 is preferably placed between the manifold 66 and the orifice 38 to prevent debris from clogging the system 10, and particularly the orifice 38. In a preferred embodiment, the volume between the inlet 30 and the orifice 38 is kept as small as possible due to the difficulty of clearing refrigerant and other material out of this area.

The size of the orifice 38 determines the rate of flow of refrigerant through the test chamber 14 for analysis by the oxygen sensor 16. In a preferred embodiment, the orifice 38 allows a flow of refrigerant that is as small as possible to limit refrigerant loss and avoid freezing up a portion of the system 10 as a result of releasing refrigerant. The preferred flow rate out of the orifice 38 is at or below approximately 70 milliliters per second.

The orifice 38 provides refrigerant to the test chamber 14 through the inlet 42. Refrigerant flows into and fills the inner chamber 56 of the test chamber 14. Refrigerant contained within the inner chamber 56 is then released from the test chamber 14 through the vent 46. In a preferred embodiment, the vent 46 opens to the atmosphere and is of adequate size to create an over-pressure condition within the inner chamber 56 that is within the tolerance range of the oxygen sensor 16. By creating an over-pressure condition within the inner chamber 56, the air existing within the inner chamber 56 is forced out as refrigerant flows into the inner chamber 56. The over-pressure condition prevents air or refrigerant that is released through the vent 46 from the inner chamber 56, from re-entering the inner chamber 56 through the vent 46 and disrupting ongoing oxygen measurements. In a preferred embodiment, the over-pressure condition within the inner chamber 56 is created with a pressure level below approximately 5 psi and preferably below 1 psi.

In order to achieve the over-pressure condition within the inner chamber 56, the vent 46 must be sized appropriately. The size of the vent 46, however, is related to the flow rate created by the orifice 38. In a preferred embodiment, the size of the vent 46 is between approximately 0.1 and 0.3 inches in diameter and is preferably 0.15 inches in diameter.

The oxygen sensor 16, coupled to the test chamber 14 through the first port 44, analyzes the contents of the inner chamber 56 to produce a signal which is a function of the oxygen level contained within the inner chamber 56. In a preferred embodiment the signal is received by the electronic controller 40 which is connected to the oxygen sensor 16. The electronic controller 40 processes the signal from the oxygen sensor 16.

The electronic controller 40 preferably controls the operation of the solenoid 28 based upon the oxygen level measured by the oxygen sensor 16 and the pressure level measured by the pressure sensor 34. If the oxygen sensor 16 consistently measures acceptable low levels of oxygen, then the electronic controller 40 will open the solenoid 28 on a less frequent basis to sample the refrigerant supply over time to ensure there is no oxygen contamination. However, if the oxygen sensor 16 measures an unsatisfactory level of oxygen in the refrigerant, then the electronic controller 40 will go into a continuous operating mode opening the solenoid 28 whenever the pressure level measured by the pressure sensor 34 falls below a desired level, and closing the solenoid 28 once the desired pressure level is achieved. The optimal oxygen and pressure levels for the operation of the system 10 could also be adjusted by the electronic controller 40 depending on the refrigerant system being evaluated. This could be accomplished by use of an input key pad or similar device.

The electronic controller 40 also uses the signal from the oxygen sensor 16 to generate an output signal. In a preferred embodiment, the display 41, is connected to the electronic controller 40 to receive the output signal and provide an electronic display with a digital read out. The display 41 could also be an analog display or a simple indicator identifying whether the oxygen level is satisfactory or not.

The display 41 could also be connected directly to the oxygen sensor 16. The display 41 thus indicates the level of oxygen within the inner chamber 56. In a preferred embodiment, the oxygen sensor 16, is one similar to a class R-22A oxygen sensor produced by Sensor Technologies (Teledyne Analytical Instruments). Additionally, the display 41 is preferably a digital readout indicating the percentage of air contained within the inner chamber 56 based upon the oxygen measurement.

In order to clear out the inner chamber 56, or field calibrate the oxygen sensor 16 prior to testing the refrigerant supply 60, air is flushed through the inner chamber 56. This could be accomplished by cycling air through the system 10, or alternatively, including the air pump 18. If used, the air pump 18 is communicably connected with and controlled by the electronic controller 40. When activated, the air pump 18 blows air into the inner chamber 56 through the second port 48. That air is then released through the vent 46.

In a preferred embodiment, the vent 46 which opens to the atmosphere is located at a point on the test chamber 14 below the inlet 42 and the second port 48 if used. Additionally, the first port 44, which is coupled to the oxygen sensor 16, is located at a point on the test chamber 14 above the inlet 42 and the second port 48 if used. Positioning the vent 46 and the first port 44 in this manner, helps prevent liquid refrigerant or contaminant such as oil or other particles from coming into contact with the oxygen sensor 16 and creating inaccuracies in the readings or damaging the oxygen sensor 16. Instead, liquid refrigerant or contaminants will discharge from the inner chamber 56 through the vent 46 and escape into the atmosphere. Preferably, the vent 46 is located on the bottom 52 of the test chamber 14 while the first port 44 is located on the top 50 of the test chamber 14. Location of the vent 46 at the bottom 52 prevents any buildup of liquid refrigerant or contaminants within the inner chamber 56. Entrained oil vapors and droplets would instead flow with the refrigerant vapor or drop as a result of gravity through the opening of the vent 46.

The refrigerant air analyzer and purge system 10 is preferably a hand-held self-contained instrument. Power requirements for the system 10 are minimal and self-contained. The means for connecting 12, which limits the flow rate of refrigerant, operates with minimal power for short periods of time while the oxygen sensor 16, the display 20 and the air pump 18, if included, require minimal power that is received from a battery that powers the electronic controller 40.

In operation, evacuation of the refrigerant air analyzer and purge system 10 is not necessary to clean out the system 10 after each analysis. Rather, the distal end coupling 24 of the test hose 22 can be connected to a pressurized air source that will purge any remaining refrigerant or contaminants within the means for connecting 12 by passing them out through the vent 46. As previously discussed, this will also clear out the test chamber 14 which could alternatively be cleared out by use of the air pump 18.

Although the present invention has been described with reference to preferred embodiments, workers skilled in the art will recognize that changes may be made in form and detail without departing from the spirit and scope of the invention. A different type of oxygen sensor could be used or placed in a different location within the test chamber. Also, the bottom of the test chamber could funnel toward the vent to aid in preventing any contaminant buildup within the test chamber. A recovery container could additionally be placed below the vent to recover the contents passing through the test chamber and avoid their release into the atmosphere. An outlet valve could be used in conjunction with the recovery container if necessary to avoid re-entry of previously tested particles into the inner chamber of the test chamber. A keypad, keyboard or other similar device could be used in conjunction with the electronic controller to adjust the allowed oxygen or pressure levels within the system. Various types of displays to identify the air or oxygen level within the test chamber are also available.

With the present invention, a refrigerant system or supply can be analyzed for the presence of air which is then purged with an inexpensive, hand-held, self-contained portable device to insure efficient and proper operation of the refrigerant system or supply.

What is claimed is:

1. A refrigerant air analyzer and purge system, the system comprising:

a vented test chamber having an inlet for receiving refrigerant;

an oxygen sensor coupled to the test chamber for producing a signal which is a function of an oxygen level within the test chamber;

a test hose having first and second ends, the first end being connected to a refrigerant supply;

a solenoid having an inlet and an outlet wherein the inlet is connected to the second end of the test hose; and a flow regulator connected between the outlet of the solenoid and the test chamber, wherein the flow regulator selectively provides refrigerant to the test chamber below an established rate and provides an output display of the air level within the test chamber as a function of the signal from the oxygen sensor.

2. A refrigerant air analyzer and purge system, the system comprising:

a vented test chamber having an inlet for receiving refrigerant;

an oxygen sensor coupled to the test chamber for producing a signal which is a function of an oxygen level within the test chamber;

means for connecting between the inlet of the test chamber and a refrigerant supply to selectively regulate the flow of refrigerant to the test chamber below an established rate; and means for providing an output display of the air level within the test chamber as a function of the signal from the oxygen sensor.

3. The air analyzer and purge system of claim 1, wherein the flow regulator comprises:

an orifice connected to the outlet of the solenoid;

a pressure switch positioned between the outlet of the solenoid and the orifice for generating a signal as a function of the pressure level between the outlet of the solenoid and the orifice;

an electronic controller which is connected to the pressure switch and the solenoid for controlling the operation of the solenoid as a function of the signal received from the pressure switch; and a display for indicating the air level within the test chamber.

4. The air analyzer and purge system of claim 3, wherein the orifice includes a screen between the outlet of the solenoid and the orifice.

5. The air analyzer and purge system of claim 3, wherein the display is connected to the electronic controller and the electronic controller receives and processes the signal which is a function of the oxygen level within the test chamber from the oxygen sensor and generates an output to the display for indicating the air level within the test chamber.

6. The air analyzer and purge system of claim 5, wherein the display is digital.

7. The air analyzer and purge system of claim 1, wherein the flow regulator maintains pressure at the outlet at or below approximately 60 pounds per square inch.

8. The air analyzer and purge system of claim 1, wherein the flow regulator includes means for adjusting the pressure level at the outlet of the solenoid.

9. The air analyzer and purge system of claim 1, wherein the flow regulator maintains a flow rate into the test chamber at or below approximately 70 milliliters per second.

10. The air analyzer and purge system of claim 1, wherein the oxygen sensor is coupled to the test chamber above the inlet.

11. The air analyzer and purge system of claim 1, wherein the vent is located below the inlet.

12. The air analyzer and purge system of claim 1, wherein the size of the vent is related to the flow of refrigerant created by the flow regulator to generate an over-pressure condition within the test chamber below approximately 5 pounds per square inch.

13. The air analyzer and purge system of claim 1, wherein the signal generated by the oxygen sensor which is a function of the oxygen level within the chamber is an electrical signal.

14. The air analyzer and purge system of claim 1, wherein an air pump is included that is coupled to the test chamber through a port.

15. A refrigerant air analyzer and purge system, the system comprising:

a vented test chamber having an inlet for receiving refrigerant;

an oxygen sensor coupled to the test chamber for producing a signal which is a function of the oxygen level within the test chamber; and means for controlling a flow rate of refrigerant having an inlet for connection to a refrigerant supply, an outlet for providing refrigerant to the inlet of the test chamber to generate an over pressure condition within the chamber below approximately 5 pounds per square inch while connected to the oxygen sensor for indicating the air level within the test chamber.

16. The air analyzer and purge system of claim 15, wherein the means for controlling comprises a test hose, a solenoid and a flow regulator such that the test hose is connected to the refrigerant supply and to an inlet of the solenoid, which in turn is connected through an outlet to a flow regulator which provides refrigerant to the test chamber below an established rate and provides the indication of the air level within the test chamber.

17. The air analyzer and purge system of claim 16, wherein the flow regulator comprises:

an orifice connected to the outlet of the solenoid;

a pressure switch positioned between the outlet of the solenoid and the orifice for generating a signal as a function of the pressure between the outlet of the solenoid and the orifice;

an electronic controller which is connected to the pressure switch and the solenoid for controlling the operation of the solenoid as a function of the signal received from the pressure switch; and a display for indicating the air level within the test chamber.

18. The air analyzer and purge system of claim 17, wherein the orifice includes a screen at an end connected to the outlet of the solenoid.

19. The air analyzer and purge system of claim 16, wherein the flow regulator maintains the pressure at the outlet of the solenoid at or below approximately 60 pounds per square inch.

20. The air analyzer and purge system of claim 16, wherein the pressure level maintained by the flow regulator is adjustable.

21. The air analyzer and purge system of claim 16, wherein the flow regulator maintains the flow rate into the chamber at or below approximately 70 milliliters per second.

22. The air analyzer and purge system of claim 15, wherein the oxygen sensor is coupled to the test chamber above the inlet.

23. The air analyzer and purge system of claim 15, wherein the vent is located below the inlet.

24. A refrigerant air analyzer and purge system, the system comprising:

a vented test chamber having an inlet for receiving refrigerant and having a port;

an oxygen sensor coupled to the test chamber for producing a signal which is a function of the oxygen level within the test chamber;

an air pump coupled to the test chamber through the port; and means for controlling a flow rate of refrigerant having an inlet for connection to a refrigerant supply, an outlet for providing refrigerant to the inlet of the test chamber while connected to the oxygen sensor for indicating the air level within the test chamber.

25. The air analyzer and purge system of claim 15, wherein the signal generated by the oxygen sensor which is a function of the oxygen level within the chamber is an electrical signal.

26. The air analyzer and purge system of claim 17, wherein the display is connected to the electronic controller such that the electronic controller receives and processes the signal which is a function of the oxygen level within the test chamber from the oxygen sensor and generates an output to the display for indicating the air level within the test chamber.

27. The air analyzer and purge system of claim 26, wherein the display is digital.

28. The air analyzer and purge system of claim 15, wherein an air pump is included that is coupled to the test chamber through a port.

29. A refrigerant air analyzer and purge system, the system comprising:

a test hose for connecting the system to a refrigerant supply to produce a flow of refrigerant;

a solenoid having an inlet and an outlet, wherein the inlet is connected to the test hose for receiving refrigerant;

an orifice connected to the outlet of the solenoid to receive refrigerant and maintain a flow rate at or below approximately 70 milliliters per second;

a pressure switch connected between the solenoid and the orifice for producing a signal as a function of the pressure level between the outlet of the solenoid and the orifice;

an electronic controller connected to the solenoid and the pressure switch for controlling the operation of the solenoid as a function of the signal produced by the pressure switch;

a vented test chamber having an inlet to receive refrigerant from the orifice;

an oxygen sensor coupled to the test chamber for producing a signal which is a function of the oxygen level within the test chamber; and means for providing a display as a function of the oxygen level within the test chamber from the signal produced by the oxygen sensor.

30. The air analyzer and purge system of claim 29, wherein the electronic controller controls the openings and closing of the solenoid to maintain a pressure level at the outlet of the solenoid at or below approximately 60 pounds per square inch.

31. The air analyzer and purge system of claim 29, wherein the pressure maintained by the controller at the outlet of the solenoid is adjustable.

32. The air analyzer and purge system of claim 29, wherein the orifice maintains a flow rate at or below approximately 70 milliliters per second.

33. The air analyzer and purge system of claim 29, wherein the oxygen sensor is coupled to the test chamber above the inlet.

34. The air analyzer and purge system of claim 29, wherein the vented test chamber has a vent located below the inlet.

35. The air analyzer and purge system of claim 34, wherein the size of the vent is related to the flow of refrigerant provided by the orifice to generate an over-pressure condition within the test chamber below approximately 5 pounds per square inch.

36. The air analyzer and purge system of claim 29, wherein the signal generated by the oxygen sensor is connected to the electronic controller for processing and generating an output signal to the means for providing a display.

37. The air analyzer and purge system of claim 36, wherein the means for providing a display is a digital electronic display.

38. The air analyzer and purge system of claim 29, wherein a screen is placed between the orifice and the solenoid.

39. The air analyzer and purge system of claim 29, wherein an air pump is included that is coupled to the test chamber through a port.

40. A method for identifying and purging air from a refrigerant supply using a refrigerant air analyzer and purge system, the method comprising:

connecting the air analyzer and purge system to the refrigerant supply through means for controlling a flow rate of refrigerant at an inlet of the means for controlling a flow rate;

generating a flow of refrigerant out of the refrigerant supply and into the means for controlling a flow rate;

measuring the oxygen content within a test chamber having an inlet which is connected to an outlet of the means for controlling a flow rate by use of an oxygen sensor coupled to the test chamber as refrigerant flows through the test chamber from the inlet and out of a vent;

displaying the air content within the test chamber as a function of the measurement by the oxygen sensor; and maintaining the flow of refrigerant out of the refrigerant supply by the means for controlling until the oxygen content measured by the oxygen sensor is below an acceptable level.

41. The method of claim 40, and further including purging the test chamber by an air pump coupled to the test chamber.

42. The method of claim 40, wherein generating a flow of refrigerant comprises:

measuring the pressure level between a solenoid, which has an inlet connected to the refrigerant supply by a test hose, and an orifice, which is connected between an outlet of the solenoid and the test chamber, with a pressure switch which creates a signal as a function of the pressure level;

opening the solenoid as a function of the pressure level between the solenoid and the orifice by an electronic controller which is connected to the pressure switch and the solenoid.

43. The method of claim 42, wherein the electronic controller receives the measurement of the oxygen content from the oxygen sensor as part of the analysis for opening the solenoid.

44. The method of claim 42, wherein the pressure level between the solenoid and the orifice is at or below approximately 60 pounds per square inch.

45. The method of claim 40, wherein the established flow rate of refrigerant into the inlet of the test chamber is below approximately 70 milliliters per second.

46. A refrigerant air analyzer and purge system, the system comprising:

a vented test chamber having an inlet for receiving refrigerant and having a vent which is located below the inlet;

an oxygen sensor coupled to the test chamber for producing a signal which is a function of an oxygen level within the test chamber; and means for connecting between the inlet of the test chamber and a refrigerant supply which controls a flow rate of refrigerant into the test chamber and receives the signal from the oxygen sensor for providing an output display.

47. A refrigerant air analyzer and purge system, the system comprising:

a vented test chamber having an inlet for receiving refrigerant and having a vent;

an oxygen sensor coupled to the test chamber for producing a signal which is a function of an oxygen level within the test chamber; and means for connecting between the inlet of the test chamber and a refrigerant supply which controls a flow rate of refrigerant into the test chamber, wherein the size of the vent is related to the flow of refrigerant created by the means for connecting to generate an over-pressure condition within the test chamber below approximately 5 pounds per square inch, and the means for connecting receives the signal from the oxygen sensor for providing an output display.

48. A refrigerant air analyzer and purge system, the system comprising:

a vented test chamber having an inlet for receiving refrigerant and having a port;

an oxygen sensor coupled to the test chamber for producing a signal which is a function of an oxygen level within the test chamber;

an air pump coupled to the test chamber through the port; and means for connecting between the inlet of the test chamber and a refrigerant supply which controls a flow rate of refrigerant into the test chamber and receives the signal from the oxygen sensor for providing an output display.

49. A refrigerant air analyzer and purge system, the system comprising:

a vented test chamber having an inlet for receiving refrigerant;

an oxygen sensor coupled to the test chamber for producing a signal which is a function of the oxygen level within the test chamber; and means for controlling a flow rate of refrigerant having an inlet for connection to a refrigerant supply, an outlet for providing refrigerant to the inlet of the test chamber while connected to the oxygen sensor for indicating the air level within the test chamber, wherein the means for controlling comprises a test hose, a solenoid and a flow regulator such that the test hose is connected to the refrigerant supply and to an inlet of the solenoid, which in turn is connected through an outlet to a flow regulator which provides refrigerant to the test chamber below an established rate and provides the indication of the air level within the test chamber.

50. A refrigerant air analyzer and purge system, the system comprising:

a vented test chamber having an inlet for receiving refrigerant and having a vent which is located below the inlet;

an oxygen sensor coupled to the test chamber for producing a signal which is a function of the oxygen level within the test chamber; and means for controlling a flow rate of refrigerant having an inlet for connection to a refrigerant supply, an outlet for providing refrigerant to the inlet of the test chamber while connected to the oxygen sensor for indicating the air level within the test chamber.

* * * * *